US008306667B2

(12) United States Patent
Baba et al.

(10) Patent No.: US 8,306,667 B2
(45) Date of Patent: Nov. 6, 2012

(54) AIR-CONDITIONING APPARATUS

(75) Inventors: Masanobu Baba, Tokyo (JP); Masahiko Takagi, Tokyo (JP); Norikazu Ishikawa, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 507 days.

(21) Appl. No.: 12/511,123

(22) Filed: Jul. 29, 2009

(65) Prior Publication Data

US 2010/0125370 A1 May 20, 2010

(30) Foreign Application Priority Data

Nov. 17, 2008 (JP) ..... 2008-293474

(51) Int. Cl.
*G05D 23/00* (2006.01)
*F25D 21/06* (2006.01)

(52) U.S. Cl. ..... 700/276; 62/155; 62/156

(58) Field of Classification Search ..... 700/276; 62/80, 159, 160, 179, 234, 130, 155, 156; 236/51, 1 E See application file for complete search history.

(56) References Cited

U.S. PATENT DOCUMENTS

| | | | | |
|---|---|---|---|---|
| 5,046,323 | A | 9/1991 | Kuwahara | |
| 5,050,396 | A | 9/1991 | Ohkoshi et al. | |
| 5,379,606 | A | 1/1995 | Katsuki et al. | |
| 5,775,116 | A | 7/1998 | Matsumoto et al. | |
| 6,102,114 | A | 8/2000 | Nishihara et al. | |
| 6,263,686 | B1 * | 7/2001 | Burkhart | 62/155 |
| 2004/0255601 | A1 | 12/2004 | Kwon et al. | |
| 2006/0207269 | A1 * | 9/2006 | Jung et al. | 62/130 |
| 2006/0254294 | A1 | 11/2006 | Shimamoto et al. | |
| 2008/0178615 | A1 * | 7/2008 | Yoon et al. | 700/276 |
| 2008/0179411 | A1 * | 7/2008 | Park et al. | 236/51 |
| 2008/0306632 | A1 | 12/2008 | Miki et al. | |
| 2009/0099698 | A1 | 4/2009 | Masui et al. | |

FOREIGN PATENT DOCUMENTS

| | | |
|---|---|---|
| EP | 0 570 130 | 11/1993 |
| EP | 0 801 274 | 10/1997 |
| EP | 1 091 178 | 4/2001 |
| EP | 2 023 052 | 2/2009 |
| EP | 2 096 367 | 9/2009 |
| GB | 2 230 873 | 10/1990 |
| GB | 2 235 790 | 3/1991 |

(Continued)

OTHER PUBLICATIONS

Partial European Search Report issued in the corresponding Application No. 09009899.7-2301 dated Mar. 31, 2010.

(Continued)

*Primary Examiner* — Charles R Kasenge
*Assistant Examiner* — Steven Garland
(74) *Attorney, Agent, or Firm* — Buchanan Ingersoll & Rooney, PC

(57) ABSTRACT

To achieve a reduction in power consumption by allowing a plurality of air conditioners to communicate with each other and thereby leveling their air-conditioning capacities with no load variations involved by temperature variations. An air-conditioning apparatus 100 may include a plurality of air conditioners and a computing section for control, where each air conditioner includes an indoor unit and an outdoor unit that form a closed refrigeration cycle. The indoor units of the plurality of air conditioners are installed in an area to be air-conditioned. The computing section for control may allow the plurality of air conditioners to communicate with each other, thereby leveling their air-conditioning capacities based on air-conditioning load detected by each air conditioner.

6 Claims, 6 Drawing Sheets

FOREIGN PATENT DOCUMENTS

| | | | |
|---|---|---|---|
| JP | 63-302237 | | 12/1988 |
| JP | 03-001031 | * | 1/1991 |
| JP | 03-001031 A | | 1/1991 |
| JP | 03-175228 A | | 7/1991 |
| JP | 05-196276 A | | 8/1993 |
| JP | 06-074531 A | | 3/1994 |
| JP | 07-167519 | | 7/1995 |
| JP | 07-167519 A | | 7/1995 |
| JP | 10-009725 A | | 1/1998 |
| JP | 10-259944 A | | 9/1998 |
| JP | 2002-156142 | | 5/2002 |
| JP | 2002-372282 | * | 12/2002 |
| JP | 2004-293810 A | | 10/2004 |
| JP | 2005-049022 | | 2/2005 |
| WO | WO 2007/138704 | | 12/2007 |
| WO | WO 2008/084635 | | 7/2008 |

OTHER PUBLICATIONS

Search Report dated May 2, 2011, issued in the corresponding European Patent Application No. 11001409.9-2301.

European Search Report issued in the corresponding European Application No. 09009899.7-2301 dated Jul. 8, 2010.

Notice of Rejection dated Sep. 7, 2010, issued in the corresponding Japanese Patent Application No. 2008-293474, and an English Translation thereof.

Office Action dated Jan. 19, 2012, issued in the corresponding Chinese Patent Application No. 200910159682.X, and a Partial English Translation thereof.

Office Action (Notice of Reasons for Rejection) dated Apr. 10, 2012, issued in corresponding Japanese Patent Application No. 2010-247035, and an English Translation thereof. (4 pages).

* cited by examiner

AIR-CONDITIONING APPARATUS

BACKGROUND OF THE INVENTION

1. Field of the Invention

The present invention relates to an air-conditioning apparatus configured to include a plurality of air conditioners. More particularly, the present invention relates to the air-conditioning apparatus that allows the plurality of air conditioners to communicate with each other, although they generally operate individually, to achieve efficient energy saving performance and promote comfort.

2. Description of the Related Art

Air conditioners for business applications are usually installed in large spaces of offices or stores. It is a common practice, in such cases, that a group of air conditioners is operated and controlled by one remote control. An example of this case is disclosed in JP 07-167519 A.

With reference to JP 07-167519 A, a plurality of air conditioners is operated individually based on instructions by a single remote control so that room temperatures reach a set temperature by heating or cooling. There is nothing more than that.

Therefore, an air conditioner installed in a location near an entrance or a window where higher air-conditioning load is required compared to other parts of a room requires high capacity. A high capacity operation results in low efficiency (=capacity/input). Therefore, if the air conditioners are operated individually, then the room temperature becomes nonuniform. This may reduce the overall efficiency of the group of air conditioners.

In addition, the heat exchanger of the outdoor unit of an air conditioner may be frosted during heating when outside temperatures are low, and frosts may grow. Therefore, defrosting is required at regular intervals. A defrost operation is generally performed by running the outdoor unit exclusively by a refrigerating cycle for cooling while the operation of the indoor unit sending warm air into a room is suspended. Since the heating operation is thus temporarily stopped for defrosting, room temperatures are reduced. Furthermore, those air conditioners may reach a point to start defrosting almost simultaneously since they are controlled to start heating operations simultaneously as a group. If the group of air conditioners warming a room together perform their defrost operations all at once, then a serious reduction in room temperatures may create less comfort.

In addition to that, a low-load cooling operation may be performed in a rainy season or the like when the discomfort index is high because the temperature is not so high but the humidity is high. In such a low-load cooling operation, each air conditioner operates at a high evaporation temperature and a high sensible heat ratio (sensible heat capacity/full capacity) during cooling, i.e., an operation with low dehumidification capacity. Therefore, room air is not sufficiently dehumidified, which cannot improve comfort. Then, if the set temperature of room air is lowered for more comfort, then the power consumption is increased and above all the user of the air conditioner would feel cold. This creates less comfort.

SUMMARY OF THE INVENTION

The present invention is directed to solving problems such as those described above. It is an object of the present invention to reduce the power consumption of an air-conditioning apparatus, by allowing a plurality of air conditioners to communicate with each other, and thereby leveling their air-conditioning capacities with no load variations involved by temperature nonuniformity.

It is another object of the present invention to prevent less comfort by a reduction in room temperatures, by allowing a plurality of air conditioners to communicate with each other, and thereby preventing two or more air conditioners from performing their defrost operations simultaneously during heating.

It is still another object of the present invention to promote comfort, by allowing a plurality of air conditioners to communicate with each other during cooling, and thereby adjusting air-conditioning load so that several air conditioners perform a cooling operation with high capacity at a low evaporation temperature and a low sensitive heat ratio, and the rest of the plurality of air conditioners perform their cooling operations with less capacity. This means that not every air conditioner performs the same operation with low capacity at a high evaporation temperature and a high sensible heat ratio. This may allow an air-conditioning apparatus to perform a low-load cooling operation, which provides an overall dehumidification performance acceptable without causing room temperatures to decrease.

It is still another object of the present invention to allow an air conditioning apparatus to pretend to perform a reheating dehumidifying operation, by allowing a plurality of air conditioners to communicate with each other during cooling, and thereby allowing several air conditioners among a plurality of air conditioners to perform a heating operation.

These and other objects of the embodiments of the present invention are accomplished by the present invention as hereinafter described in further detail.

According to one aspect of the present invention, an air-conditioning apparatus may include a plurality of air conditioners and a computing section for control that allows the plurality of air conditioners to communicate with each other to level the air-conditioning capacities of the air conditioners based on air-conditioning load detected by each of the plurality of air conditioners. Each air conditioner may include an indoor unit and an outdoor unit that form a closed refrigerating cycle. The indoor units of the air conditioners may be installed in an area to be air-conditioned.

According to another aspect of the present invention, an air-conditioning apparatus may include a plurality of air conditioners and a computing section for control that allows the plurality of air conditioners to communicate with each other to include an air conditioner that performs a dehumidification capacity increase operation, and an air conditioner that adjusts air-conditioning load to prevent room temperatures from decreasing below a set temperature, upon receipt of an instruction to start cooling. Each of the plurality of air conditioners may include an indoor unit and an outdoor unit that form a closed refrigerating cycle. The indoor units of the air conditioners may be installed in an area to be air-conditioned.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
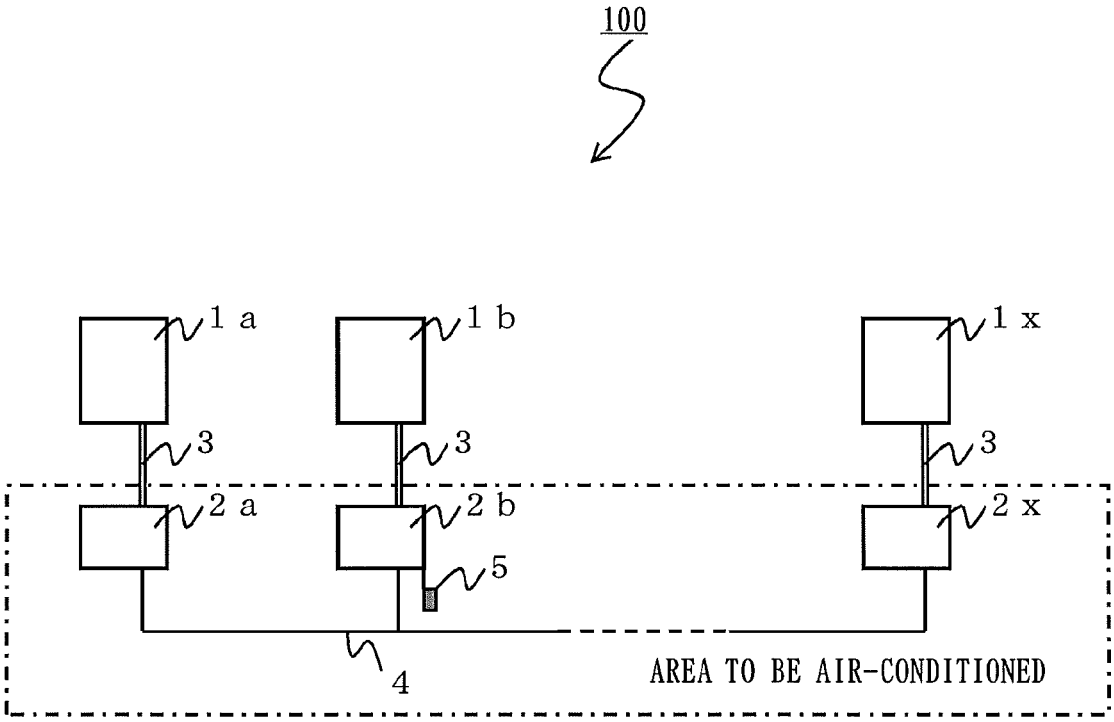
FIG. 1 shows a block diagram of an air-conditioning apparatus 100 according to a first embodiment to a fourth embodiment.

Reference will now be made in detail to the present preferred embodiments of the invention, examples of which are illustrated in the accompanying drawings, wherein like reference numerals indicate like devices throughout the several views.

Embodiment 1.

Figure 2:
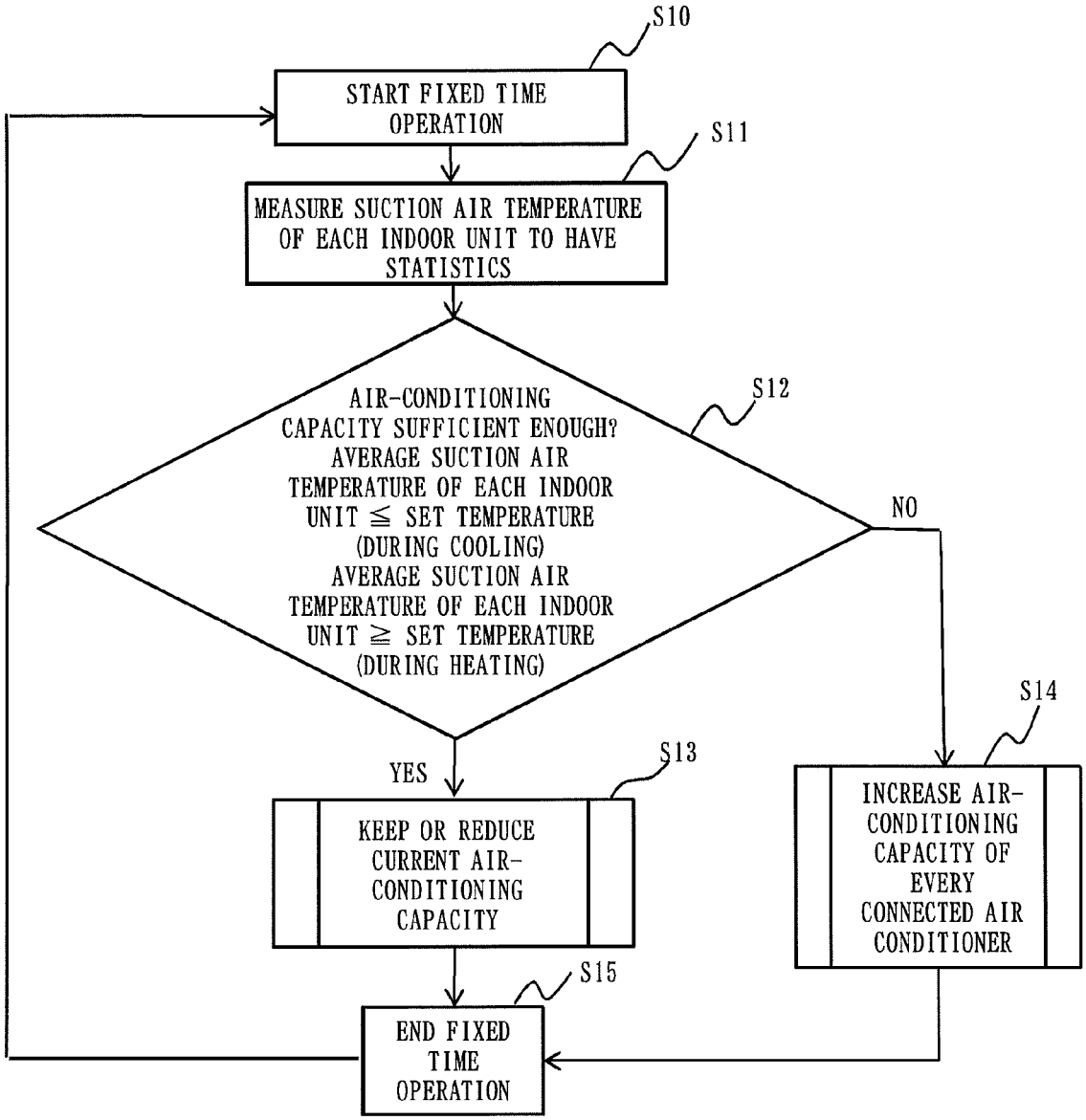
FIG. 2 shows a flow chart illustrating a temperature adjustment control according to the first embodiment.
Figure 3:
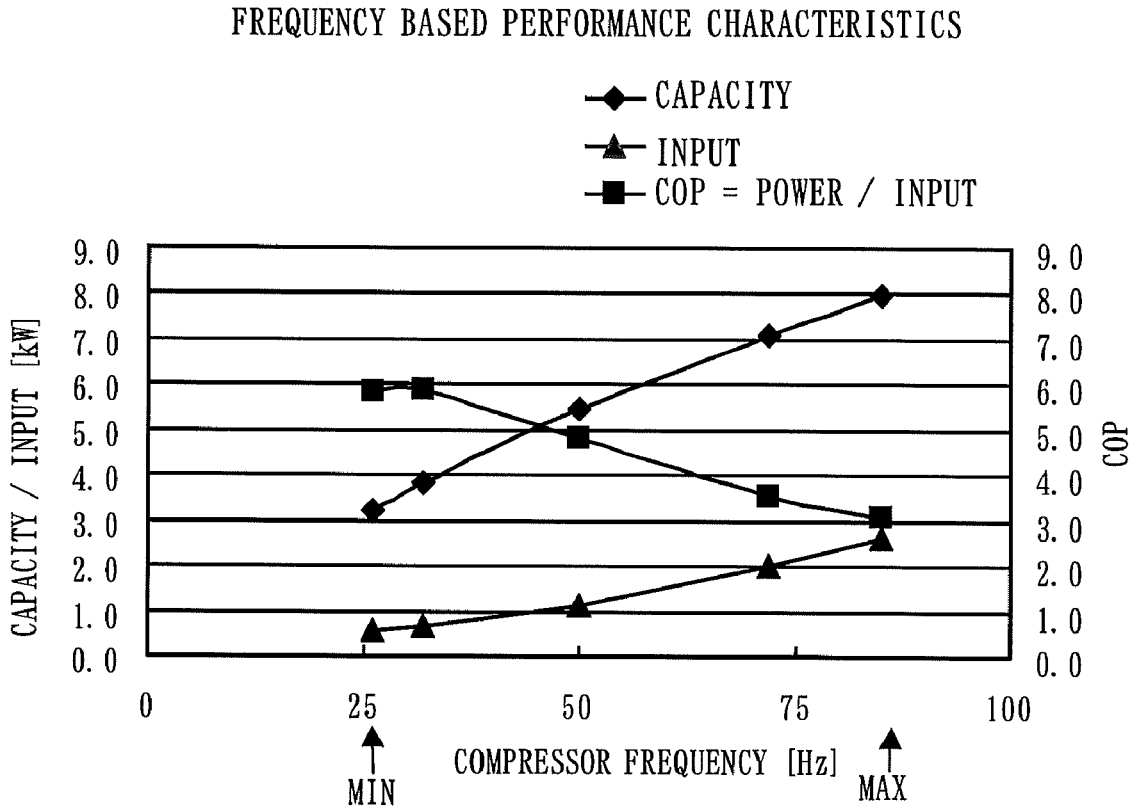
FIG. 3 shows capacity, input and COP (Coefficient of Performance=capacity/input) indicating operating efficiency, to the frequency of an inverter driven compressor used in a general air conditioner.

FIG. 1 and FIG. 2 illustrate a first embodiment. FIG. 1 shows a block diagram of an air-conditioning apparatus 100. FIG. 2 shows a flow chart illustrating a temperature adjustment control. FIG. 3 shows capacity, input and COP (Coefficient of Performance=capacity/input) indicating operating efficiency, to the frequency of an inverter driven compressor used in a general air conditioner.

As shown in FIG. 1, the air-conditioning apparatus 100 may include a plurality of air conditioners. More specifically, the air-conditioning apparatus 100 may include a plurality of outdoor units 1*a*, 1*b*, . . . and 1*x*, a plurality of indoor units 2*a*, 2*b*, . . . and 2*x*, pipes/wires 3 for connecting the outdoor units 1*a*, 1*b*, . . . and 1*x* and the indoor units 2*a*, 2*b*, . . . and 2*x*, respectively, connecting wires 4 for allowing the indoor units 2*a*, 2*b*, . . . and 2*x* to communicate with one another, and a remote control 5. The pipes of the pipes/wires 3 may be refrigerant pipes, and the wires may be power supply wires and communication wires.

The example of FIG. 1 employs a wired remote control for the remote control 5, which is attached to the indoor unit 2*b*, for example. Alternatively, the remote control 5 may be a wireless remote control. An arbitrary number of remote controls 5 may also be installed.

The air conditioners may be of a ceiling cassette type, for example. Generally, a ceiling cassette air conditioner means a separate type air conditioner that is equipped with a ceiling mounted indoor unit and an outdoor unit connected to the indoor unit. The indoor unit and the outdoor unit forms a closed refrigeration cycle.

Each air conditioner of the air-conditioning apparatus 100 shown in FIG. 1 has an individual closed refrigeration cycle. This is different in configuration from a so-called multi-type air conditioner that is equipped with one outdoor unit and a plurality of indoor units.

The indoor units 2*a*, 2*b*, . . . and 2*x* and the outdoor units 1*a*, 1*b*, . . . and 1*x* communicate with one another via the internal/external communication lines of the pipes/wires 3 and the connecting wires 4. This may allow a computing section for control mentioned below to obtain statistics on the operational frequencies of compressors installed in the outdoor units 1*a*, 1*b*, . . . and 1*x*.

The compressors in the outdoor units 1*a*, 1*b*, . . . and 1*x* may be inverter driven. Therefore, the operational frequency is not fixed, but varies based on instructions. The compressor may be a rotary compressor, a scroll compressor, or the like.

AS shown in FIG. 1, three air conditioners are assumed to be connected with one another. If the outdoor unit 1*a* operates with 80 percent of the maximum air-conditioning capacity, the outdoor unit 1*b* operates with 50 percent of the maximum air-conditioning capacity, and the outdoor unit 1*c* operates with 50 percent of the maximum air-conditioning capacity, then it may be sufficient for the three air conditioners to run with an average 60 percent of the maximum air-conditioning capacity to cope with the load of the room. Given this fact, the indoor units 2*a*, 2*b* and 2*c* and the outdoor units 1*a*, 1*b* and 1*c* may be controlled so that the three air conditioners operate with 60 percent of the maximum air-conditioning capacity, by the computing section for control, which is not shown in the figures.

This computing section for control may be installed in one of the outdoor unit 1*a*, 1*b*, . . . and 1*x*, the indoor units 2*a*, 2*b*, . . . and 2*x*, and the remote control 5. Alternatively, a separate device equipped with the computing section for control may be newly added.

More specifically, as shown in FIG. 2, this may be implemented by leveling the operational frequencies of the outdoor units 1*a*, 1*b*, . . . and 1*x*, at fixed time intervals, so that the average value of the suction air temperatures of each indoor unit 2*a*, 2*b*, . . . , 2*x* reaches a set temperature preset by the remote control 5.

With reference to FIG. 2, when a fixed time operation is started (S10), the suction air temperatures of each indoor unit 2*a*, 2*b*, . . . , 2*x* are measured by a temperature detector (e.g., a thermistor) installed at their suction intakes, not shown, to have statistics (S11).

Then, an average suction air temperature of each indoor unit 2*a*, 2*b*, 2*x* is compared with the set temperature to determine whether cooling capacity or heating capacity is sufficient enough (S12). The set temperature of air sucked at the suction intake is preset by a user by the remote control 5.

During cooling, it is determined that the cooling capacity is sufficient enough if average suction air temperature of each indoor unit 2*a*, 2*b*, . . . , 2*x*≦set temperature.

During heating, it is determined that the heating capacity is sufficient enough if average suction air temperature of each indoor unit 2*a*, 2*b*, . . . , 2*x*≧set temperature.

If it is determined in S12 that the air-conditioning capacity (i.e., cooling capacity or heating capacity) is sufficient, then the current air-conditioning capacity is maintained or reduced (S13).

If it is determined that air-conditioning capacity is not sufficient, then every connected outdoor unit is controlled to increase its air-conditioning capacity (S14). Air-conditioning capacity is not sufficient if average suction air temperature of each indoor unit 2*a*, 2*b*, . . . , 2*x*>set temperature during cooling, or if average suction air temperature of each indoor unit 2*a*, 2*b*, . . . , 2*x*<set temperature during heating.

The fixed time operation is completed here (S15), and the same operation is repeated afterward.

FIG. 3 shows capacity, input and COP (Coefficient of Performance=capacity/input) indicating operating efficiency, to the frequency of an inverter driven compressor used in a general air conditioner. The example of FIG. 3 illustrates a relation among compressor frequency, capacity/input, and COP when the compressor frequency is varied in the range between 25 Hz to 90 Hz.

FIG. 3 shows that if compressor frequency is increased for high load, then COP is reduced, and if compressor frequency is reduced, to the contrary, then COP is increased.

In the case of varying compressor frequency, air-conditioning capacity and input may vary as follows: The air-conditioning capacity at a maximum frequency is around 2.5 times higher than that at a minimum frequency, for example. The input at the maximum frequency is around five times more than that at the minimum frequency, for example. Therefore, the COP (Coefficient of Performance=air-conditioning capacity/input) at the maximum frequency is around a half of that at the minimum frequency.

Thus, the air-conditioning apparatus 100 of this embodiment may achieve a reduction in power consumption by allowing the plurality of air conditioners to communicate with one another and thereby leveling their air-conditioning capacities with no load variations involved by temperature nonuniformity.

Such a load leveling operation may allow for a reduction in power consumption of the air-conditioning apparatus described in this and other embodiments characterized as follows: The air-conditioning apparatus 100 may be configured to include the plurality of air conditioners and the computing section for control, where each air conditioner includes the indoor unit 2*a*, 2*b*, . . . , 2*x* and the outdoor unit 1*a*, 1*b*, . . . , 1*x* that form a closed refrigeration cycle. The indoor units 1*a*, 1*b*, . . . and 1*x* of the plurality of air conditioners are installed in an area to be air-conditioned. The computing section for control may allow the plurality of air conditioners to communicate with one another, thereby leveling their air-conditioning capacities based on air-conditioning load detected by each air conditioner.

Embodiment 2.

The plurality of air conditioners of the air-conditioning apparatus 100 of FIG. 1 may be characterized as follows, during heating: The indoor units 2*a*, 2*b*, . . . and 2*x* communicating with the outdoor units 1*a*, 1*b*, . . . and 1*x* via the internal/external communication lines of the pipes/wires 3 and the connecting wire 4 are allowed to obtain statistics on the frosted states of the outdoor units 1*a*, 1*b*, . . . and 1*x*. More specifically, the frosted state of each outdoor unit 1*a*, 1*b*, . . . , 1*x* may be obtained by the temperatures of pipes and the operating time for heating of an outdoor heat exchanger installed in the outdoor unit, or the like.

Figure 4:
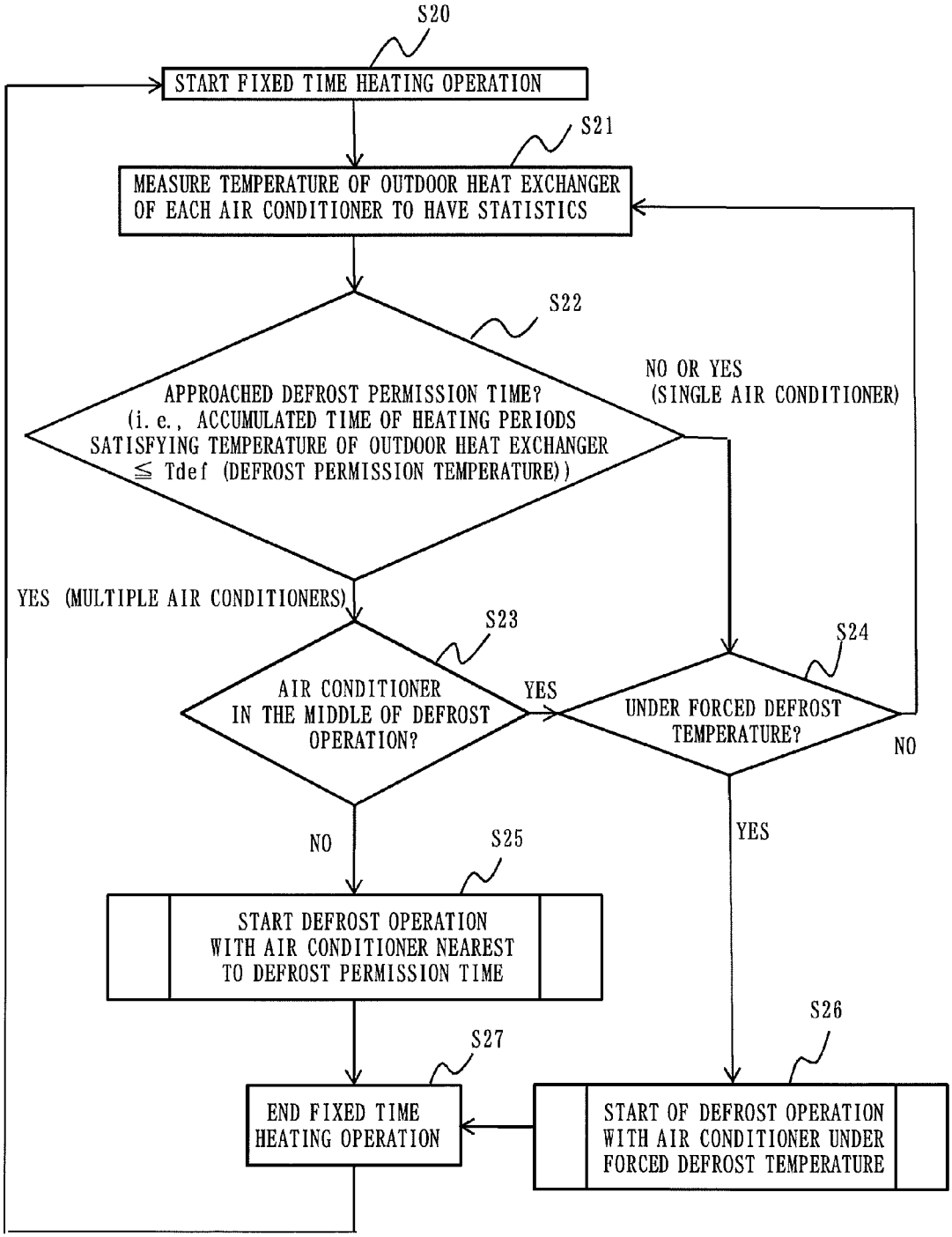
FIG. 4 shows a flow chart illustrating a control of a defrost operation of an outdoor unit during heating according to the second embodiment.

FIG. 4 shows a flow chart illustrating a defrost control according to this embodiment. The defrost control is now described with reference to FIG. 4.

When a fixed time heating operation is started (S20), the temperature of the outdoor heat exchanger of each air conditioner is measured to have statistics (S21). The temperature of the outdoor heat exchanger may be measured by a temperature detector (e.g., a thermistor) attached to the outdoor heat exchanger, which is not shown in the figures.

It is determined (S22) whether each air conditioner has approached a defrost permission time, based on the temperature of the outdoor heat exchanger of the air conditioner that is measured to have statistics in S21.

The "defrost permission time" may be defined as follows: When an air conditioner starts heating, the temperature of the outdoor heat exchanger as an evaporator is reduced gradually. In such a situation, time of heating periods when the temperature of the outdoor heat exchanger is under a predetermined "defrost permission temperature Tdef" (e.g., −5° C. to −2° C.) is accumulated. A predetermined value (e.g., 60 minutes) of an accumulated time of heating periods when the temperature is under the predetermined temperature below zero (e.g., −5° C. to −2° C.) is defined as the "defrost permission time".

If it is determined in S22 that two or more air conditioners where the accumulated time of heating periods that satisfies the "temperature of outdoor heat exchanger≦defrost permission temperature Tdef" have approached the predetermined defrost permission time, then it is determined whether there is an air conditioner that is performing a defrost operation (S23).

If it is determined in S23 that there is no air conditioner that is performing a defrost operation, then an air conditioner that is the nearest to the defrost permission time is started to perform a defrost operation (S25).

The fixed time heating operation is completed here (S27), and the process returns to S20.

The defrost operation may be performed by running the outdoor unit exclusively by a refrigerating cycle for cooling while the operation of the indoor unit sending warm air into the room is stopped (the fan is stopped). More specifically, the outdoor heat exchanger of the outdoor unit may operate as a condenser.

If it is determined in S23 that an air conditioner is performing a defrost operation, then it is determined whether the temperature of the outdoor heat exchanger of the air conditioner where the accumulated time of heating periods that satisfies "temperature of outdoor heat exchanger≦defrost permission temperature Tdef" has approached the defrost permission time is below a forced defrost temperature (e.g., −20° C. to −10° C.) (S24).

If it is determined in S24 that the temperature of the outdoor heat exchanger of the air conditioner where the accumulated time of heating periods that satisfies "temperature of outdoor heat exchanger≦defrost permission temperature Tdef" has approached the defrost permission time is below the forced defrost temperature, then the air conditioner having the temperature determined to be below the forced defrost temperature is started to perform a defrost operation, regardless of whether or not there is another air conditioner that is performing a defrost operation (S26).

If it is determined in S24 that the temperature of the outdoor heat exchanger of the air conditioner where the accumulated time of heating periods that satisfies "temperature of outdoor heat exchanger≦defrost permission temperature Tdef" has approached the defrost permission time is not below the forced defrost temperature, meaning that there is an air conditioner in the state of a defrost operation, then no defrost operation is started and the process returns to S21 for the following reason. In such a situation where there is an air conditioner that is performing a defrost operation, if another air conditioner performs a defrost operation, then the overall heating capacity of the air-conditioning apparatus 100 is reduced.

If it is determined in S22 that there is no or a single air conditioner where the accumulated time of heating periods that satisfies "temperature of outdoor heat exchanger≦defrost permission temperature Tdef" has approached the predetermined defrost permission time, then it is determined whether the temperature of the outdoor heat exchanger of the single air conditioner is below the forced defrost temperature (e.g., −20° C. to −10° C.) (S24).

If the temperature of the outdoor heat exchanger of the single air conditioner is below the forced defrost temperature (e.g., −20° C. to −10° C.), then the air conditioner is started to perform a defrost operation (S26).

If it is determined in S24 that the temperature of the outdoor heat exchanger of the single air conditioner is not below the forced defrost temperature, then no defrost operation is started and the process returns S21.

After S26, the fixed time heating operation is completed (S27), like S25, and the process returns to S20.

The above described defrost operation is performed by the computing section for control. The computing section for control may be installed in one of the outdoor units 1*a*, 1*b*, . . . and 1*x*, the indoor units 2*a*, 2*b*, . . . and 2*x*, and the remote control 5. Alternatively, a separate device equipped with the computing section for control may be newly added.

As described above, the air conditioners may thus be controlled during heating such that an air conditioner does not start its defrost operation unless the temperature of the outdoor heat exchanger is below the forced defrost temperature while another air conditioner is in the middle of a defrost operation, or starts its defrost operation at an earlier stage when another air conditioner is likely to start its defrost operation simultaneously. The air conditioners that are allowed to communicate with one another may thereby prevent two or more air conditioners from performing simultaneous defrost operations, as much as possible, during heating when outside temperatures are low. This may prevent the air-conditioning apparatus 100 from having insufficient heating capacity and thereby avoid a reduction in room temperatures and less comfort.

Embodiment 3.

The plurality of air conditioners of the air-conditioning apparatus 100 of FIG. 1 may be characterized as follows during cooling: The indoor units 2*a*, 2*b*, . . . and 2*x* communicating with the outdoor units 1*a*, 1*b*, . . . and 1*x* via the internal/external communication lines of the pipes/wires 3 and the connecting wire 4 are allowed to obtain statistics on the temperatures of the indoor heat exchangers (i.e., evaporation temperatures) of the indoor units 2*a*, 2*b*, . . . and 2*x*.

If a person in a room (i.e., an area to be air-conditioned) issues an instruction to give priority to dehumidification by a remote control 5, then the air-conditioning capacities of several air conditioners are increased and their evaporation temperatures are reduced. The air-conditioning capacities of the rest of the air conditioners are reduced, or their operations are switched from cooling to blowing, in order to adjust increased overall air-conditioning capacity, thereby preventing an excessive reduction in room temperatures.

Such an operation to reduce air-conditioning capacities for adjusting overall air-conditioning capacity at the time of an increase in overall air-conditioning capacity is a load adjustment operation performed to prevent room temperatures from decreasing below the set temperature.

Figure 5:
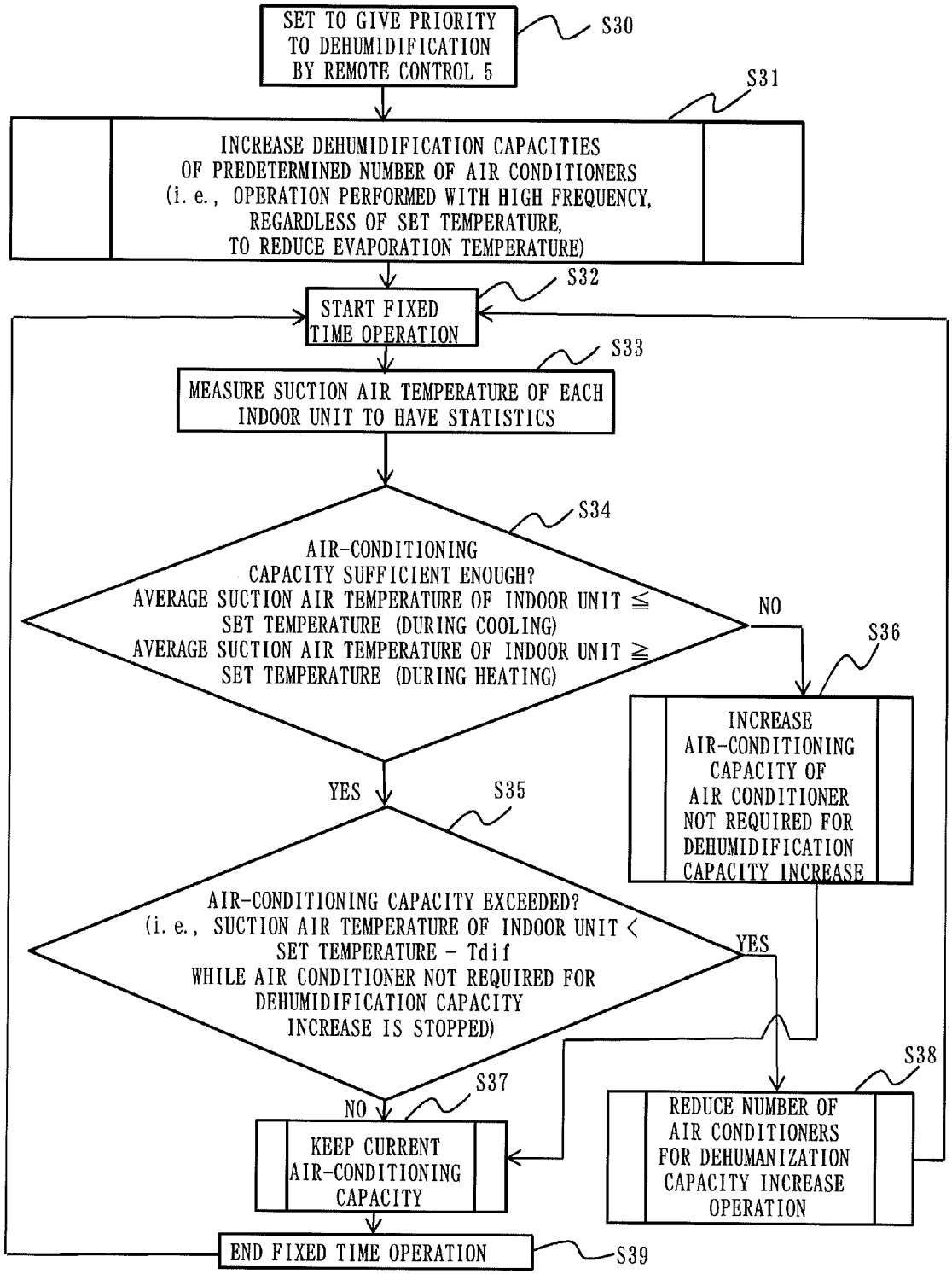
FIG. 5 shows a flowchart illustrating a dehumidification control according to the third embodiment.

FIG. 5 shows a flow chart illustrating a dehumidification control, according to a third embodiment. Specifically, when it is set from the remote control 5 to give priority to dehumidification, then 10 to 50 percent (i.e., a predetermined number) of the number of connected air conditioners of the plurality of air conditioners 2*a*, 2*b*, . . . and 2*x* are controlled to perform a dehumidification capacity increase operation to increase their dehumidification capacities, as shown in FIG. 5. The rest of the air conditioners are controlled so that their air-conditioning capacities reach the set temperature. If the operations of the rest of the air conditioners are stopped but the room temperatures are still reduced, then the air conditioners performing their dehumidification capacity increase operations are stopped, thereby preventing a further reduction in the room temperatures.

The "dehumidification capacity increase operation" may be defined as a cooling operation performed at a low evaporation temperature and a low sensitive heat ratio (sensitive heat capacity/full capacity).

With reference to FIG. 5, when a person in a room (i.e., an air-conditioned area) issues an instruction to give priority to dehumidification (S30) by the remote control 5, then 10 to 50 percent (a predetermined number) of connected air conditioners of the plurality of air conditioners 2*a*, 2*b*, . . . and 2*x* are controlled to perform their dehumidification capacity increase operations. More specifically, in the dehumidification capacity increase operation, the compressor is operated at high frequency, regardless of the set temperature, thereby reducing the evaporation temperature of the temperature of the indoor heat exchanger (S31).

Subsequently, the fixed time operation is started (S32). The suction air temperatures of each indoor unit 2*a*, 2*b*, . . . , 2*x* are measured by a temperature detector (e.g., a thermistor) installed at a suction intake of each indoor unit, which is not shown in the figures, to have statistics (S33).

Then, the average suction air temperature of each indoor unit 2*a*, 2*b*, . . . , 2*x* is compared with the set temperature (S34).

During cooling, the air-conditioning capacity is determined to be sufficient if average suction air temperature of each indoor unit 2*a*, 2*b*, . . . , 2*x*≦set temperature.

During heating, the air-conditioning capacity is determined to be sufficient if average suction air temperature of each indoor unit 2*a*, 2*b*, . . . , 2*x*≧set temperature.

If it is determined in S34 that air-conditioning capacity is sufficient, then it is determined whether air-conditioning capacity has exceeded the limit (S35).

In that case, the operation of an indoor unit not performing its dehumidification capacity increase operation is stopped. Then, if average suction air temperature of each indoor unit<the set temperature−Tdif, where Tdif is a predetermined temperature difference, it is determined that air-conditioning capacity has exceeded the limit.

If it is determined that air-conditioning capacity has exceeded the limit, then the number of air conditioners performing their dehumidification capacity increase operations is reduced (S38) and the process returns to S32.

If it is determined that air-conditioning capacity has not exceeded the limit, then the current air-conditioning capacity is maintained (S37), then the fixed time operation is completed (S39), and the process returns to S32.

If it is determined in S34 that air-conditioning capacity is not sufficient, then the air-conditioning capacity of an air conditioner not performing its dehumidification capacity increase operation is increased (S36), then the air-conditioning capacity is maintained (S37), then the fixed time operation is completed (S39), and the process returns to S32.

If a specific air conditioner is always set to increase its cooling capacity, then the user near by the indoor unit of that specific air conditioner would feel less comfortable with cold. Given this fact, air conditioners are controlled to change their roles of increasing dehumidification capacity and adjusting (temperature) capacity alternately in every 10 to 20 minutes, thereby preventing less comfort.

The dehumidification control operation described above is performed by the computing section for control, as is the case with the first embodiment. The computing section for control may be installed in one of the outdoor units 1*a*, 1*b*, . . . and 1*x*, the indoor units 2*a*, 2*b*, . . . and 2*x*, and the remote control 5. Alternatively, a separate device equipped with the computing section for control may be newly added.

Figure 6:
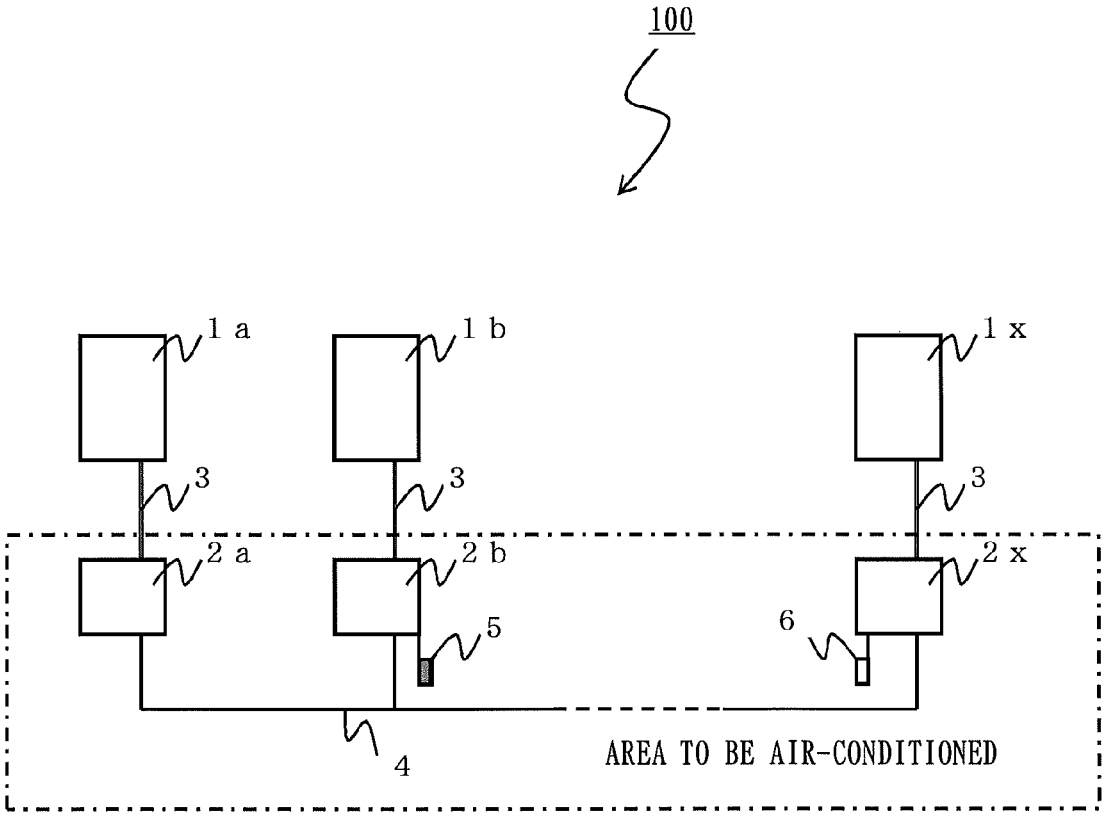
FIG. 6 shows a block diagram of the air-conditioning apparatus 100 according to the third embodiment.

FIG. 6 shows a block diagram of the air-conditioning apparatus 100, according to the third embodiment. The air-conditioning apparatus 100 described above is the type that increases dehumidification capacity qualitatively by reducing the evaporation temperature when a sensor to detect humidity is not equipped in each indoor unit 2*a*, 2*b*, . . . , 2*x*. Alternatively, as shown in FIG. 6, a humidity sensor 6 may be mounted on one of the plurality of air conditioners, as an optional extra. The humidity sensor 6 may be mounted after the air conditioner is installed. Then, operations may be controlled so that a detected value of the humidity sensor 6 reaches a predetermined target value, which may promote more comfort.

During dehumidification, the dehumidification capacity is large when the evaporation temperature is reduced. Therefore, the volume of airflow of each indoor unit may be reduced. This control may prevent, as much as possible, the user near by the indoor unit of an air conditioner from feeling less comfortable with cold. Wind direction may also be controlled so that the volume of airflow is reduced as much as possible, for better comfort. It is desirable therefore that the wind direction is oriented at such an angle that wind does not blow against a recipient.

Embodiment 4.

With reference to the air-conditioning apparatus 100 of the third embodiment, when a person in a room (i.e., an area to be air-conditioned) issues instructions to further raise the priority of dehumidification by the remote control 5, at least one of the plurality of air conditioners may be controlled to perform a heating operation. This may allow the amount of dehumidification to be increased without reducing overall room temperatures. The volume of airflow and wind direction may also be controlled for better comfort in this case. It is also desirable to set the volume of airflow and wind direction so that warm air does not blow against a recipient.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An air-conditioning apparatus comprising:

a plurality of air conditioners, each air conditioner including an indoor unit and an outdoor unit that form a closed refrigerating cycle, wherein each indoor unit is installed in an area to be air-conditioned; and a computing section for control that allows the plurality of air conditioners to communicate with each other to level the air-conditioning capacities of the plurality of air conditioners based on air-conditioning load detected by each air conditioner, wherein each outdoor unit includes an outdoor heat exchanger and a temperature detector for measuring a temperature of the outdoor heat exchanger, and wherein the computing section determines whether each air conditioner has an accumulated time of operating in a heating mode, during which the temperature of a corresponding outdoor heat exchanger is under a predetermined temperature, and determines if the accumulated time is approaching a defrost permission time.

2. The air-conditioning apparatus of claim 1, wherein, responsive to two or more air conditioners, each having an accumulated time approaching the defrost permission time, the computing section controls the two or more air conditioners so that defrost operations for outdoor units of the two or more air conditioners are not performed simultaneously during heating.

3. The air conditioning apparatus of claim 2, wherein, responsive to no air conditioner performing a defrost operation, the computing section starts a defrost operation of an air conditioner having an accumulated time closest to the defrost permission time.

4. The air conditioning apparatus of claim 2, wherein, responsive to an air conditioner performing a defrost operation, the computing section determines whether any air conditioner having an accumulated time approaching the defrost permission time has an outdoor heat exchanger with a temperature below a forced defrost temperature, and the computing section starts a defrost operation of the air conditioner having the outdoor heat exchanger with the temperature below the forced defrost temperature regardless of whether of whether or not there is another air conditioner performing a defrost operation.

5. An air conditioning apparatus comprising:

a plurality of air conditioners, each of the air conditioners including an indoor unit and an outdoor unit that form a closed refrigerating cycle, wherein indoor units of the plurality of air conditioners are installed in an area to be air-conditioned, and a computing section for control configured to equalize air-conditioning capacity of each air conditioner based on air-conditioning load detected by each air conditioner based on mutual communication of the plurality of air conditioners, wherein the air conditioning apparatus, during heating:

determines whether there is an air conditioner performing a defrost operation if there are two or more air conditioners, each of which has an accumulated time of performing a heating operation during which a temperature of a corresponding outdoor heat exchanger≦a defrost permission temperature, and determines if the accumulated time is approaching a predetermined defrost permission time;

starts a defrost operation of an air conditioner whose accumulated time of heating operation is the nearest to the predetermined defrost permission time of all the two or more air conditioners if there is no air conditioner performing a defrost operation;

determines whether the temperature of the outdoor heat exchanger of each of the two or more air conditioners, the accumulated time of heating operation of which is approaching the predetermined defrost permission time, is below a forced defrost temperature if there is an air conditioner performing a defrost operation;

starts a defrost operation of an air conditioner whose outdoor heat exchanger has a temperature below a forced defrost temperature, regardless of other air conditioners performing a defrost operation, if the temperature of the outdoor heat exchanger of each of the two or more air conditioners, the accumulated time of heating operation of which is approaching the predetermined defrost permission time, is below the forced defrost temperature; and starts a defrost operation of no air conditioner if the temperature of the outdoor heat exchanger of each of the two or more air conditioners, the accumulated time of heating operation of which is approaching the predetermined defrost permission time, is not below the forced defrost temperature.

6. The air-conditioning apparatus according to claim 5, further comprising a temperature detector for measuring suction air of each indoor unit installed in the area to be air-conditioned and obtaining a statistical result as an average suction air temperature, wherein the air-conditioning capacities of the plurality of air conditioners are controlled uniformly by the outdoor units connected to the respective indoor units according to a difference between the average suction air temperature and a set temperature present by a user.

* * * * *